United States Patent [19]

Weishew

[11] 4,384,544

[45] May 24, 1983

[54] LIQUID APPLICATION SYSTEM

[76] Inventor: Joseph F. Weishew, 3934 Davisville Rd., Hatboro, Pa. 19040

[21] Appl. No.: 250,876

[22] Filed: Apr. 3, 1981

[51] Int. Cl.[3] ..... B05C 1/08

[52] U.S. Cl. ..... 118/224; 118/227; 118/262

[58] Field of Search ..... 118/223, 224, 225, 227, 118/228, 262

[56] References Cited

U.S. PATENT DOCUMENTS

| | | | |
|---|---|---|---|
| 2,393,529 | 1/1946 | Harrigan | 118/262 |
| 2,631,643 | 3/1953 | Schueler | 118/262 X |
| 2,714,365 | 8/1955 | Rowlands | 118/262 |
| 2,774,684 | 12/1956 | Fuchinari | 118/202 X |
| 3,303,814 | 2/1967 | Nitchie | 118/262 X |
| 3,703,156 | 11/1972 | Niesen et al. | 118/224 X |

*Primary Examiner*—John P. McIntosh
*Attorney, Agent, or Firm*—Robert J. Mooney

[57] ABSTRACT

For applying a liquid, such as liquid wax, to a continuously fed sheet material a first pair of cylindrical rollers, each having a smooth surface which is exposed to and wetted by the liquid to be applied, are rotatably mounted about substantially parallel axes and spaced apart to permit intimate tangential contact therebetween with both sides of the sheet material to be coated. A second pair of cylindrical rollers located a distance from the first pair are similarly mounted and positioned to make contact with the sheet material in like manner. A pair of cylindrical engraved rolls, each having an array of guadrangular cells formed along the surfaces thereof, are respectively positioned between each of the first and second pairs of rollers and are rotatably mounted on movable axes so that the engraved rolls urge against one or both of the roller pairs during rotation. The quadrangular cells serve to provide a multiplicity of miniature cups that remove a certain fraction of the liquid from the surfaces of the first pair of rollers thereafter transferring the fraction to the surfaces of the second roller pair which in turn deposit the fraction on the sheet material to effect improved continuous coating of the sheet material.

10 Claims, 2 Drawing Figures

LIQUID APPLICATION SYSTEM

BACKGROUND OF THE INVENTION

The present invention relates to liquid applicators and more particularly to a system and technique for applying a controlled coating of liquid to a continuous sheet of material.

In applying a continuous coating of a liquid, such as hot wax, to sheet stock material, such as plain paper or corrugated board, it is economically desirable to optimize usage of the coating liquid. Such optimized usage is generally effected by depositing a minimally sufficient amount of liquid on the sheet stock so as to produce an effective coating. As a result, accurate control of the amount of deposits is an essential requirement of liquid applicators, especially hot wax applicators.

Existing liquid applicators have been reasonably successful in depositing continuous coatings of the liquid to the surface of substantially flat sheet material. However, such liquid applicators have not been entirely satisfactory in transferring controlled amounts of the liquid to the surface of the material so that accurate layers of the coating are consistently deposited. Furthermore, current liquid wax applicating systems have not been able to deposit uniform coatings of relatively low viscosity liquid wax except at very slow feed rates of 60 feet per minute or less.

SUMMARY OF THE INVENTION

Accordingly, it is an object and general purpose of the present invention to provide an improved system and technique for applying continuous liquid coatings in controlled amounts to the surface of sheet material.

Another object of the present invention is to provide a liquid applicating system that permits more efficient utilization of a liquid coating supply by depositing a precise, uniform coating in various ranges to either surface of a continuously-fed sheet material.

A further object of the present invention is to provide a continuous liquid coating system that effectively applies low viscosity liquids such as liquid wax to the surface of sheet material fed at substantially high rates.

A still further object of the present invention is to provide a liquid applicating system that is simple yet reliable in set up and performance, inexpensive to manufacture, and economical to operate.

Briefly, these and other objects of the present invention are accomplished by an improved liquid applicating system wherein a first pair of cylindrical rollers, each having a smooth surface of a relatively hard but resilient material exposed to and wetted by the liquid to be applied, are rotatably mounted about substantially parallel axes and spaced apart to permit intimate contact therebetween with both sides of a continuously-fed sheet material. A second pair of identical cylindrical rollers located a distance from the first pair are similarly mounted and positioned to make contact with the sheet material in like manner. A pair of cylindrical engraved rolls, each having an array of quadrangular cells formed on the surfaces thereof are respectively positioned between each of the first and second pairs of rollers on either side of the sheet material and are rotatably mounted on movable axes so that the engraved rolls urge against one or both of the roller pairs during rotation. When the first pair of rollers makes contact with the respective engraved rolls, a certain fraction of the liquid coating is removed via the quadrangular cells with the remaining liquid being impressed upon the sheet material. The fraction of liquid removed by the cells of the engraved rolls is then transferred to the surface of each of the second pair of rollers upon contact therewith and is subsequently impressed upon the sheet material.

For a better understanding of these and other aspects of the present invention, reference may be made to the following detailed description taken in conjunction with the accompanying drawing in which like reference characters designate like items throughout the figures thereof.

DESCRIPTION OF THE PREFERRED EMBODIMENT

Figure 1:
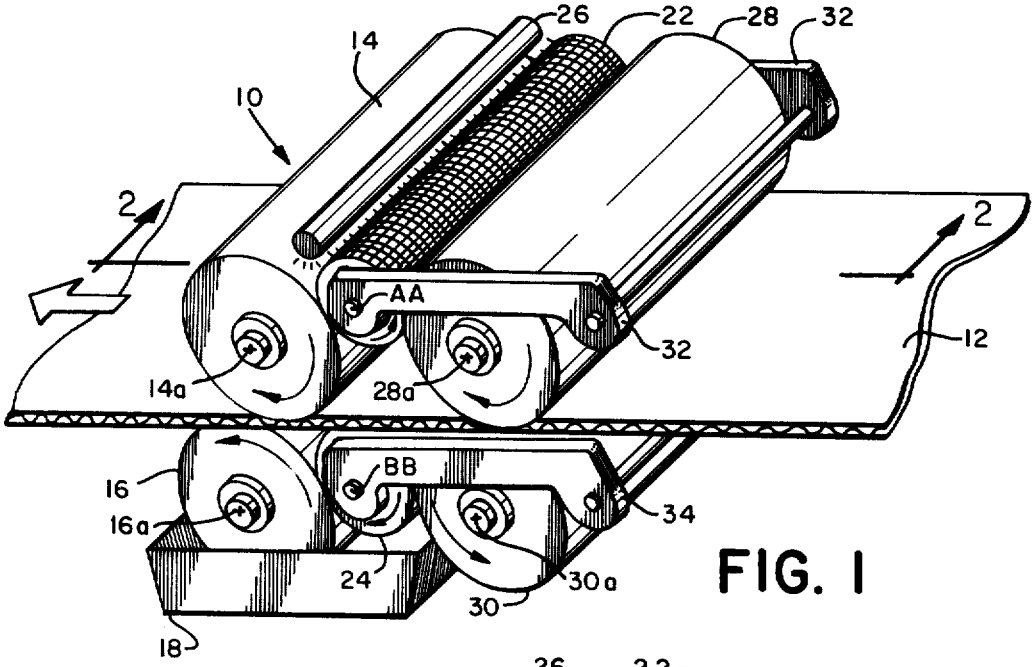
FIG. 1 schematically illustrates in perspective a liquid applicating system according to the present invention.
Figure 2:
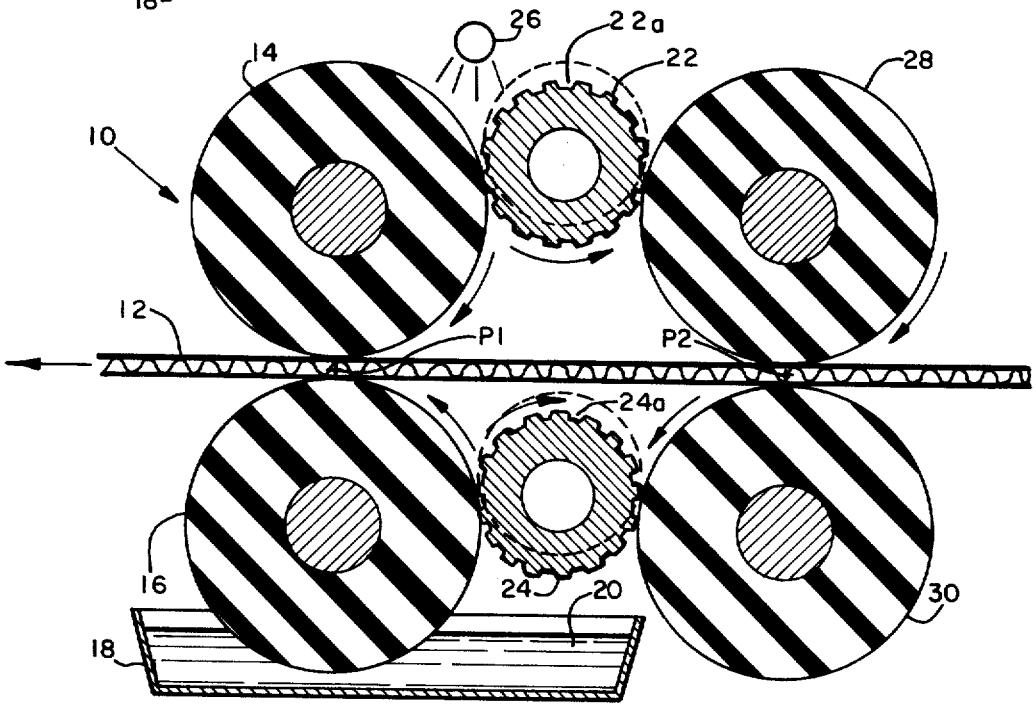
FIG. 2 is a sectional view of the liquid applicating system of FIG. 1 taken along the line 2—2.

Referring now to FIGS. 1 and 2 there is shown the liquid applicating system 10 of the present invention having a continuous stock of a sheet material 12, such as corrugated board, being fed therethrough. The applicating system 10 includes a pair of forward rollers 14 and 16 having a smooth cylindrical surface of a relatively hard but resilient material, such as rubber. The forward rollers 14 and 16 are rotatably mounted along respective cylindrical axes, 14*a* and 16*a*, disposed substantially parallel to each other and sufficiently separated to permit the sheet material 12 to be fed between the roller surfaces in intimate contact therewith.

A pan receptacle 18 for containing a supply of a liquid coating material 20, such as liquid wax, is situated immediately beneath lower forward roller 16 so that a portion of the roller 16 always lies within the coating material. A heat generating element (not shown) may be provided pan receptacle 18 to maintain the liquid coating material 20 at a certain elevated temperature for more effective coating. Alternatively, the supply of coating material 20 may be heated at its source and continuously delivered to pan recepticle 18.

A pair of rearward rollers 28 and 30 each having a smooth cylindrical surface of a hard but resilient material like forward rollers 14 and 16, are rotatably mounted on respective axes 28*a*, 30*a* which are substantially parallel to forward roller axes 14*a* and 16*a*, and are similarly separated from each other so that sheet material 12 may be fed intimately between the rearward roller surfaces and progressively through the forward rollers 14 and 16 in a plane substantially tangent to all four rollers.

A pair of cylindrical engraved rolls 22 and 24 each having an engraved cellular surface formed thereon, are respectively mounted on rotational axes, AA and BB, between the upper set of rollers, 14 and 28, and the lower set of rollers, 16 and 30, above and below the plane of sheet material 12. The respective rotational axes, AA and BB, of engraved rolls 22 and 24 are substantially parallel to each other and independently movable into either of two positions by means of eccentric lever arms 32 and 34 connected at the ends of the engraved rolls. As better shown in FIG. 2, the rotational axes AA and BB may be positioned so that the engraved rolls 22 and 24 are nestled respectively between the upper set of rollers, 14 and 28, and the lower set of rollers, 16 and 30, in intimate rolling contact with the roller surfaces. Alternatively, the eccentric lever arms 32 and 34 are adapted to move the respective rotational axes AA and BB in an upward arcuate path so that the engraved rolls 22 and 24, as shown in phantom outline in FIG. 2, are maintained in intimate rollings contact with only the surfaces of forward rollers 14 and 16, respectively.

The cellular surface of each of the engraved rolls 22 and 24 is comprised of an array of quadrangular cells 22*a* and 24*a* formed radially in a continuous pattern across the entire surface. The quadrangular cells 22*a* and 24*a* are formed with a slight taper to a predetermined depth, preferably about 0.012 inch, below the surface of the respective rolls 22 and 24 thereby providing a multiplicity of miniature cups for the retention of some of the liquid coating material 20 during cyclical rotation of the engraved rolls.

A spray dispenser 26 connected to the source of liquid coating material 20 is mounted above the upper forward roller 14 and its associated engraved roll 22. The spray dispenser 26, which is of a conventional design, directs a controlled flow of the liquid coating material 20 downward along the rolling interface between upper forward roller 14 and anilox roll 22.

In operation, upon applying a rotary drive force to either or both the forward rollers 14 and 16 or to the engraved rolls 22 and 24, the sheet material 12 to be coated is fed through the liquid applicating system 10 in accordance with the present invention. Coated with amounts of liquid material 20 via pan receptacle 18 and spray dispenser 26, forward rollers 14 and 16 rotate into intimate contact with their associated engraved rolls 22 and 24, respectively. When the coated surfaces of forward rollers 14 and 16 make contact with the surfaces of the respective engraved rolls 22 and 24, a certain fraction of the liquid coating is removed by the quadrangular cells 22*a* and 24*a*. The remaining amount of liquid coating material 20 on the forward rollers 14 and 16 is impressed upon sheet material 12 at point P1, as shown in FIG. 2.

Retaining the fraction of liquid coating material 20 removed from forward rollers 14 and 16, the quadrangular cells 22*a* and 24*a* of engraved rolls 22 and 24 transfer the retained liquid material to the respective surfaces of rearward rollers 28 and 30 upon intimate contact therewith. Rearward rollers 28 and 30 then impress the liquid coating material 20 transferred from engraved rolls 22 and 24 to the sheet material 12 at point P2.

It should be understood that movement of the engraved rolls 22 and 24 via lever arms 32 and 34 into their alternate positions apart from rearward rollers 28 and 30 will result in a coating impression on sheet material 12 at point P1 only. Accordingly, independent positioning of the engraved rolls 22 and 24 by means of their associated lever arms 32 and 34 permits adjustment of the amount of liquid coating material 20 deposited on each side of sheet material 12.

Therefore, it is apparent that the disclosed liquid applicating system provides an improved technique of applying a continuous liquid coating in controlled amounts to the surfaces of sheet material by permitting more efficient utilization of a liquid supply. In addition, the disclosed invention provides a continuous liquid coating system that effectively applies low viscosity liquids to the surfaces of sheet material fed at substantially high rates. Furthermore, the disclosed liquid applicating system is simple yet reliable in performance, inexpensive to manufacture, and economical to operate.

The rubber forming the surface of a cylindrical roller may be any suitable rubber, such as neoprene, which is non-reactive with the liquid to be applied, such as hot liquid wax. Quadrangular cells are preferred but cells with other configurations, such as triangular or circular cells of appropriate size and depth, may be used to like effect. The engraved rolls used in this invention are commercially available and are sometimes called anilox rolls.

Obviously, other embodiments and modifications of the present invention will readily come to those of ordinary skill in the art having the benefit of the teachings presented in the foregoing description and drawing. It is therefore to be understood that various changes in the details, materials, steps and arrangements of parts, which have been described and illustrated to explain the nature of the invention, may be made by those skilled in the art within the principle and scope of the invention as expressed in the appended claims.

I claim:

1. An apparatus for applying a low viscosity liquid coating material to a continuously-fed sheet material, comprising:

a first pair of cylindrical rollers each having a smooth surface for receiving the liquid coating material, said rollers being rotatably mounted and spaced apart for tangential contact therebetween of the sheet material for applying to the sheet material all of the liquid coating material which may then be on said rollers;

a pair of engraved rolls each having a regular array of regularly shaped cells impressed on the respective surfaces thereof, said engraved rolls being rotatably mounted in intimate contact with respective ones of said cylindrical rollers so that said cells are urged against the surface of said rollers after said rollers receive the liquid coating material, said cells receiving a fraction of said liquid coating material from said rollers before said rollers contact the sheet material and before said rollers apply the remaining fraction of said liquid coating material to said sheet material; and a second pair of cylindrical rollers each rotatably mounted and having a smooth surface, said second pair of rollers being spaced apart from each other for tangential contact therebetween of the sheet material and being disposed in intimate contact with respective ones of said engraved rolls so that said cells are urged against the surfaces of said second pair of rollers to transfer said fraction of liquid coating material to said second pair of rollers before said second pair of rollers contact the sheet material and apply said fraction of liquid coating material to said sheet material.

2. An apparatus according to claim 1, wherein said pair of engraved rolls are mounted on movable rotational axes for separating said rolls from intimate contact with said second pair of rollers.

3. An apparatus according to claim 1, wherein the surfaces of said first and second pairs of cylindrical rollers are composed of rubber.

4. An apparatus according to claim 3, wherein the cells of said pair of engraved rolls are quadrangular and formed to a predetermined depth.

5. An apparatus according to claim 4, wherein the depth of the quadrangular cells are about 0.012 inch.

6. An apparatus for applying liquid wax to a continuously-fed sheet material, comprising:

a first cylindrical roller having a smooth surface for receiving the liquid wax said roller being rotatably mounted for tangential contact with the sheet material;

an engraved roll having a regular array of cells impressed on the surface thereof, said engraved roll being rotatably mounted in intimate contact with said first cylindrical roller so that said cells are urged against the surface of said roller to receive a fraction of said liquid wax therefrom after said first cylindrical roller receives the liquid wax and before said first cylindrical roller contacts the sheet material; and a second cylindrical roller having a smooth surface for receiving said fraction of liquid wax from said engraved roll and being rotatably mounted for tangential contact with the sheet material and for intimate contact with said engraved roll so that said cells are urged against the surface of said second cylindrical roller to impart said fraction of liquid wax thereto before said second cylindrical roller contacts the sheet material.

7. An apparatus for applying a liquid coating material to a continuously-fed sheet material comprising:

a rotatably mounted engraved roll having a regular array of cells impressed on the surface thereof;

a first roller having a smooth surface for receiving the liquid coating material, said first roller being rotatably mounted for intimate contact with the sheet material and with said engraved roll so that the cells of said engraved roll are urged against the surface of said first roller after said first roller receives the liquid coating material, said cells receiving a fraction of said liquid coating material from said first roller before said first roller contacts the sheet material; and a second roller having a smooth surface for receiving said fraction of liquid coating material from said engraved roll, said second roller being rotatably mounted for intimate contact with the sheet of material and with said engraved roll so that the cells of said engraved roll are urged against the surface of said second roller before said second roller contacts the sheet material.

8. An apparatus according to claim 7 wherein the surface of each of said cylindrical rollers is composed of rubber.

9. An apparatus according to claim 8 wherein the cells of said engraved roll are quadrangular and formed to a predetermined depth.

10. An apparatus according to claim 9, wherein the depth of each of the quadrangular cells is about 0.012 inch.

* * * * *